US008322511B2

(12) United States Patent
Leifheit

(10) Patent No.: US 8,322,511 B2
(45) Date of Patent: Dec. 4, 2012

(54) METHOD AND APPARATUS FOR CONVEYING A CIGARETTE STREAM IN A CONTROLLED MANNER

(75) Inventor: Axel Leifheit, Häuslingen (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 1132 days.

(21) Appl. No.: 12/169,116

(22) Filed: Jul. 8, 2008

(65) Prior Publication Data

US 2009/0025737 A1 Jan. 29, 2009

(30) Foreign Application Priority Data

Jul. 26, 2007 (DE) ..... 10 2007 035 399

(51) Int. Cl.
*B65G 1/00* (2006.01)

(52) U.S. Cl. ..... 198/347.1; 193/30

(58) Field of Classification Search ..... 198/347.1, 198/836.3, 836.4, 861.1, 445, 446, 454; 193/30, 193/2 R, 15, 25 C, 25 FT, 25 R; 131/282, 131/283

See application file for complete search history.

(56) References Cited

U.S. PATENT DOCUMENTS

| | | | | | |
|---|---|---|---|---|---|
| 2,592,642 | A | * | 4/1952 | Bardet | 414/792.5 |
| 2,997,828 | A | * | 8/1961 | Ahlbor | 53/505 |
| 3,024,585 | A | * | 3/1962 | Schubert et al. | 53/236 |
| 3,026,661 | A | * | 3/1962 | Hillman et al. | 53/148 |
| 3,355,004 | A | | 11/1967 | Rupert | |
| 3,391,770 | A | * | 7/1968 | Niepmann | 193/3 |
| 3,460,687 | A | * | 8/1969 | Bardenhagen | 414/295 |
| 3,498,022 | A | * | 3/1970 | Godet | 53/149 |
| 3,509,986 | A | * | 5/1970 | Focke | 198/347.3 |
| 3,565,237 | A | * | 2/1971 | Strydom | 198/572 |
| 3,646,971 | A | * | 3/1972 | Godet | 138/46 |
| 4,042,094 | A | * | 8/1977 | Schmermund | 198/347.1 |
| 4,338,057 | A | * | 7/1982 | Molins | 414/416.09 |
| 4,365,703 | A | * | 12/1982 | Hinchcliffe et al. | 414/413 |
| RE32,001 | E | * | 10/1985 | Wahle | 414/416.05 |
| 4,555,011 | A | * | 11/1985 | Brown | 198/444 |
| 4,750,607 | A | * | 6/1988 | Focke | 198/792 |
| 4,787,497 | A | * | 11/1988 | King et al. | 198/347.2 |
| 4,790,333 | A | * | 12/1988 | Focke et al. | 131/283 |
| 4,856,958 | A | * | 8/1989 | Bantien | 414/414 |

(Continued)

FOREIGN PATENT DOCUMENTS

CN 1261040 A 7/2000

(Continued)

OTHER PUBLICATIONS

German Search Report.

(Continued)

*Primary Examiner* — Gene Crawford
*Assistant Examiner* — William R Harp
(74) *Attorney, Agent, or Firm* — Laurence P. Colton; Smith Risley Tempel Santos LLC

(57) ABSTRACT

A method and apparatus for conveying a cigarette stream in a controlled manner into an initially empty conveying section of a machine for producing and/or packaging cigarettes, the conveying section being delimited laterally by walls and the cigarette stream being supported during conveying by a movable supporting element which is moved together with the cigarette stream along the conveying section. The walls which delimit the conveying section laterally can be moved at least partially in order to change the cross section of the conveying section.

7 Claims, 8 Drawing Sheets

U.S. PATENT DOCUMENTS

| | | | | |
|---|---|---|---|---|
| 5,568,856 | A * | 10/1996 | Colley et al. | 198/347.2 |
| 6,540,061 | B1 * | 4/2003 | Focke et al. | 198/359 |
| 6,666,321 | B2 * | 12/2003 | Spatafora | 198/347.1 |
| 7,364,052 | B2 * | 4/2008 | Spatafora | 221/289 |
| 7,571,798 | B2 * | 8/2009 | Spatafora | 198/347.2 |
| 2007/0137662 | A1 * | 6/2007 | Borderi et al. | 131/282 |

FOREIGN PATENT DOCUMENTS

| | | | |
|---|---|---|---|
| CN | 1973702 | A | 6/2007 |
| DE | 16 32 165 | B2 | 1/1967 |
| DE | 14 86 001 | B | 4/1969 |
| DE | 19 32 547 | A | 1/1970 |
| DE | 25 01 686 | A1 | 7/1976 |
| DE | 602 03 558 | T2 | 2/2006 |
| EP | 0277363 | A2 | 8/1988 |
| EP | 1 020 126 | B1 | 7/2000 |
| EP | 1256284 | A1 | 11/2002 |
| EP | 1020126 | B1 | 5/2004 |
| EP | 1454543 | A1 | 9/2004 |
| EP | 1 704 787 | A1 | 9/2006 |
| EP | 1704787 | A1 | 9/2006 |
| EP | 1795076 | A1 | 6/2007 |
| GB | 2 017 618 | A1 | 10/1979 |
| JP | 54105300 | A | 8/1979 |
| JP | 2000211608 | A | 8/2000 |
| WO | 94/13 161 | Y | 6/1994 |

OTHER PUBLICATIONS

European Search Report on related application (Jun. 20, 2012).
State Intellectual Property Office of the People's Republic of China office action (translation into English) Feb. 28, 2012.
German Translation of Japanese Patent Office "Official Action" on related Japanese patent application (Feb. 8, 2012).

* cited by examiner

METHOD AND APPARATUS FOR CONVEYING A CIGARETTE STREAM IN A CONTROLLED MANNER

STATEMENT OF RELATED APPLICATIONS

The present application claims convention priority on German Patent Application No. 10 2007 035 399.7 having a filing date of 26 Jul. 2007, which is incorporated herein in its entirety by this reference.

BACKGROUND OF THE INVENTION

1. Technical Field

The invention relates to a method for conveying a cigarette stream in a controlled manner into an initially empty conveying section of a machine for producing and/or packaging cigarettes, the conveying section being delimited laterally by walls and the cigarette stream being supported during conveying by a movable supporting element which is moved together with the cigarette stream along the conveying section. Furthermore, the invention relates to a corresponding apparatus for conveying a cigarette stream in a controlled manner into an initially empty conveying section of a machine for producing and/or packaging cigarettes, the conveying section being delimited laterally by walls and the cigarette stream being supported during conveying by a movable supporting element which is moved together with the cigarette stream along the conveying section.

2. Related Art

Cigarettes are transported in a cigarette stream within a cigarette-making machine and/or a cigarette-packaging machine predominantly using the weight of the cigarettes. Here, the cigarettes are moved through various elements of the machine along conveying paths or conveying sections.

A problem is always what is known as starting up of the machine because there is the risk that the cigarettes fall in an uncontrolled manner into the conveying paths, which are still empty at this time, and assume an oblique position and/or are damaged mechanically. For this purpose, the prior art according to Great Britain Patent No. GB 2 017 618 A1 provides the use of a platform, on which the cigarettes or the cigarette stream rest/rests during the downwardly directed transport in a conveying section. In this way, the cigarettes can be inserted into the provided slopes without the risk of incorrect positioning and/or mechanical damage.

European Patent No. EP 1 020 126 B1 from the company of the applicant is also concerned with the above-described problem. As a solution, various supporting elements are proposed which are adapted in each case in a particular way to the corresponding conveying sections of the machine.

European Patent No. EP 1 704 787 A1 adds a new solution to the prior art for the problem. Namely, for the first time elastic or telescopic supporting elements are proposed which serve to insert the cigarette stream. In this way, depending on the dimensions and/or course of the conveying section, the shape or the size, in particular the length, of the supporting element can be changed. However, supporting elements of this type require a complex construction and are therefore susceptible to technical disruptions.

Proceeding from this, the invention is based on the object of providing alternative solutions for the technical problem which is mentioned in the introduction.

BRIEF SUMMARY OF THE INVENTION

In order to achieve this object, there is provision according to the invention for the walls which delimit the conveying section laterally to be moved at least partially in order to change the cross section of the conveying section. In this way, the free cross section of the conveying section can be adapted while the cigarette stream is being conveyed in, in such a way that incorrect positioning is avoided.

Preferred developments of the method according to the invention result otherwise from the claims, the description and the drawing.

There is provision according to one preferred development of the invention for the walls to be moved in such a way that the cross section in the conveying direction widens for distributing the cigarette stream to an adjoining conveying section having a greater cross section, in particular having a greater width. This solution is advantageous, for example, when the cigarette stream is to be transferred from a narrow shaft to a wider shaft of a cigarette magazine.

There is provision in one preferred refinement of the invention for two walls of the conveying section which lie opposite one another to be moved. As an alternative, the movement of a single wall is also conceivable, while all the remaining walls of the conveying section are arranged in a fixed manner.

A further special feature comprises the fact that the walls which lie opposite one another can be moved, in particular pivoted, one after another, preferably with a time offset with respect to one another. It has been shown that the pivoting of the walls represents a solution which can be realized satisfactorily. In this way, the cross section of the conveying section can be widened gradually, without incorrect positioning of the cigarettes occurring.

The walls are preferably moved after the cigarette stream has filled the conveying section substantially completely. Accordingly, the cigarettes are conveyed into the conveying section in a manner in which they lie on the supporting element, until the cigarette stream has reached the underside of the conveying section and the conveying section is therefore filled completely with cigarettes. The walls are moved only after this, with the result that the cross section of the conveying section is enlarged and it is filled gradually by cigarettes flowing in after or cigarettes of the cigarette stream which roll to the side. In this way, the width of the cigarette stream can be enlarged in a controlled manner, without incorrect positioning of the cigarettes occurring.

There is provision for the cigarette stream to be conveyed within a cigarette machine downwards in a shaft of the supply part of the cigarette magazine, the cigarettes of the cigarette stream resting on the supporting element with their longitudinal extent transversely with respect to the conveying direction, and two walls of the shaft which lie opposite being moved apart from one another, in particular being pivoted apart from one another, according to the cigarettes which have been conveyed in, in order to increase the cross section of the shaft between the two walls, the walls being moved after the supporting element is moved out of the shaft at the lower end of the latter and the shaft is filled substantially completely with cigarettes.

An apparatus according to the invention is an apparatus for conveying a cigarette stream in a controlled manner into an initially empty conveying section of a machine for producing and/or packaging cigarettes, the conveying section being delimited laterally by walls and the cigarette stream being supported during conveying by a movable supporting element which is moved together with the cigarette stream along the conveying section. There is accordingly provision for it to be possible for the walls which delimit the conveying section to be moved at least partially in order to change the cross section of the conveying section.

The movement of the walls is preferably made possible by the movable walls of the conveying section being mounted pivotably in such a way that the cross section of the conveying section can be enlarged by pivoting of the walls. This solution is advantageous, for example, when the cigarette stream is to be transferred from a narrow shaft to a wider shaft of a cigarette magazine.

There is provision in one preferred embodiment of the invention for the pivotable walls to be arranged adjacently to fixed walls of the conveying section and/or of an adjacent conveying section or of another element of the apparatus, at least some fixed walls being assigned guides for the pivotable walls.

The apparatus according to the invention is preferably used in apparatuses in which the conveying section is part of a cigarette magazine, the cigarette magazine comprising an upper supply part and a lower shaft part having shafts for cigarettes which are separated by shaft walls, and the pivotable walls being part of the supply part. There is preferably provision in cases of this type for the supply part to be arranged with the movable walls centrally above the shaft part and to have a smaller width than the shaft part, and it being possible for the two walls which lie opposite one another to be moved, in particular pivoted, into a diverging position in such a way that the cigarette stream can be distributed over the full width of the shaft part. In this way, the width of the cigarette stream can be enlarged in a controlled manner, without incorrect positioning of the cigarettes occurring.

It is assumed in the present invention that the supporting element has substantially constant dimensions, in particular a substantially constant width. Furthermore or as an alternative, it is assumed that the supporting element is of substantially rigid configuration, that is to say, for example, as a supporting plate made from plastic or metal or as a filling body made from foamed material. Here, the dimensions of the supporting element correspond substantially to the dimensions of the conveying section in the region of the fixed walls.

There is provision in one preferred embodiment for it to be possible for the movable walls of the supply part to be adjusted between a position for conveying the cigarettes into the empty conveying section and a position after the cigarettes have been conveyed in, the walls of the supply part adjoining fixed walls of the supply part substantially upright and below in the position for conveying the cigarettes into the empty conveying section, with the result that the cross section of the supply part is substantially constant, and the adjustable walls are moved into a diverging position after filling of this conveying section, in such a way that the lower opening of the conveying section corresponds substantially to the dimensions of the adjoining shaft part having the shafts for cigarettes, with the result that the shaft part can be filled over its full width. Here, it will be the case as a rule that the supporting element can be removed from the conveying section at the lower end of the supply part, in particular can be pulled out to the side transversely with respect to the conveying direction.

The invention can be implemented in structural terms by the movable walls having at least one upper upright section and one lower section which are connected to one another via a hinge, it being possible for the two sections of the wall to be pivoted with respect to one another about a hinge axis of the hinge.

The walls can be adjusted by in each case one actuator which acts in each case on the upper uprightly oriented section of the walls and brings about the pivoting of the lower section of the wall about the hinge axis by linear movement.

The lower sections of the walls can be mounted on fixed walls which are arranged directly above the cigarette magazine, in particular in a sliding manner in slot-like apertures in the walls.

Preferred developments of the apparatus according to the invention otherwise result from the claims, the description and the drawing.

BRIEF DESCRIPTION OF THE DRAWINGS

One preferred exemplary embodiment of the invention will be described in the following text using the drawing, in which:

FIG. 4 shows the apparatus according to FIG. 1 at the beginning of the cigarette stream being conveyed in.

FIG. 6 to FIG. 8 show the apparatus according to FIG. 1 during further sequential phases of the cigarette stream being conveyed in.

DETAILED DESCRIPTION OF PREFERRED EMBODIMENTS

Figure 1:
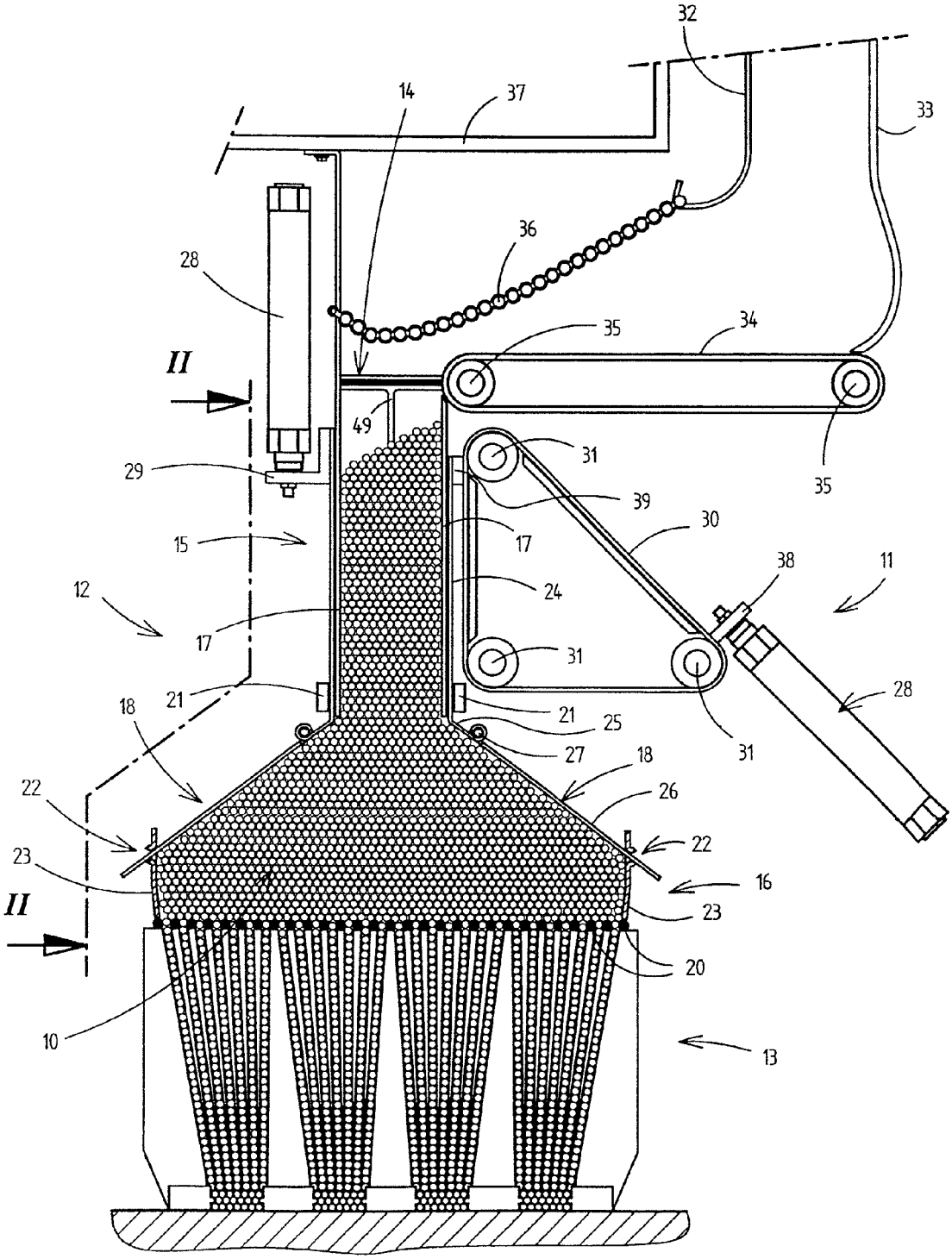
FIG. 1 shows a vertical section through an apparatus for conveying a cigarette stream into a cigarette magazine.

The invention is concerned with conveying a cigarette stream 10, that is to say a loose mass flow comprising cigarettes, into an empty conveying section of a machine for producing or for packaging cigarettes. The invention is explained using the example of conveying a cigarette stream 10 into an empty cigarette magazine 11.

The basic construction of the cigarette magazine 11 is known, for example, from European Patent No. EP 1 020 126 B1 of the applicant, which is incorporated herein. For the purpose of the complete disclosure of the invention, reference is made to this document. In this case, important constituent parts for the present invention are the construction of the cigarette magazine 11 from a supply part 12 and a shaft part 13, and the use of a supporting element 14.

The supply part 12 of the cigarette magazine 11 has a first, upper conveying section 15 having a preferably rectangular and constant cross section. In an adjoining lower conveying section 16, the cross section of the supply part 12 widens downwards in the conveying direction, as shown in FIG. 1, for example. The supply part 12 is delimited laterally by walls 17, 18, namely lateral walls 17 in the region of the upper conveying section 15 and lateral walls 18 in the region of the lower conveying section 16. A shaft, through which the cigarette stream 10 is fed in the shaft part 13, is formed by the conveying sections 15, 16 which are delimited by the walls 17, 18. At the lower end of the supply part 12, the latter has approximately the same cross-sectional dimensions as the adjoining shaft part 13 of the cigarette magazine 11. In the supply part 12, the cigarette stream 10 which is fed in in the rectangular upper conveying section 15 is distributed via the diverging region of the second conveying section 16 over the full width of the shaft part 13. The upper conveying section 15 is arranged centrally above the shaft part 13 with in each case a lateral spacing from its edges, preferably substantially centrally above the shaft part 13.

Individual shafts 19 for in each case one row of cigarettes which lie above one another are formed in the shaft part 13.

The individual shafts 19 are divided from one another by walls of the shaft part 13. Vibratory rods 20 which are arranged on the upper side of the shaft part 13 ensure a distribution of the cigarette stream 10 into the individual shafts 19. On the underside of the cigarette magazine 11, in each case packaging groups comprising cigarettes according to the contents of a cigarette pack are formed and ejected transversely with respect to the illustrated plane of the drawing.

A further known constituent part of the apparatus is the supporting element 14 which is realized here in the form of a supporting plate. The supporting element 14 has dimensions which correspond substantially to those of the upper conveying section 15. In addition, the supporting element 14 has constant, invariable dimensions. When the cigarettes are conveyed in, they are supported on the underside by the supporting element 14, with the result that the cigarettes do not fall into the empty conveying section and assume an oblique position in the process and block the conveying in. The supporting element 14 is moved continuously downwards in the supply part 12 together with the cigarette stream 10 which is flowing in, until the cigarettes reach the shaft part 13. As a rule, the supporting element 14 is subsequently pulled out of the supply part 12 transversely with respect to the plane of the drawing and is moved back into the upper initial position outside the said supply part 12. There, the supporting element 14 remains outside the supply part 12 until it is required again for the insertion of the next cigarette stream 10 and is pushed into the supply part 12 transversely with respect to the plane of the drawing.

The insertion of a cigarette stream 10 into an empty conveying section 15, 16 of the apparatus can be required, for example, after a downtime or in the event of a change of the cigarette brand which is processed on the machine.

A special feature according to the invention of the apparatus which is shown in the figures comprises the fact that part of the walls 18 which delimit the supply part 12 are of movable configuration in order to change the cross section of the supply part 12 in this region. In the present case, the walls 17 of the upper conveying section 15 of the supply part 12 are of fixed configuration. The cross section of this conveying section 15 is constant over the entire conveying height and corresponds substantially to the dimensions of the supporting element 14. The walls 18 of the second conveying section 16 are of movable configuration in contrast, in order to adapt the cross section of the supply part 12 in this region according to the cigarettes which are conveyed in.

In order to change the cross section, the walls 17 can be pivoted according to the cigarette stream 10 which is conveyed in, in accordance with the illustration in FIGS. 3, 4 and 6 to 8. On account of these measures, it can be prevented that the cigarettes of the cigarette stream 10 are positioned obliquely during conveying into the empty conveying section 16 above the shaft part 12.

Further advantageous details are shown in the following text in conjunction with the depiction of the further construction of the apparatus. In this regard, in detail:

As results from the figures, the walls 18 of the second conveying section 16 which lie opposite one another are mounted pivotably, namely on one side on guides 21 at the lower end of the corresponding walls 17 of the upper conveying section 15 and in slot-like apertures 22 in fixed walls 23 on both sides and above the shaft part 13.

The movable walls 18 comprise substantially three sections, namely a first upper section 24, in which the movable wall 18 extends rectilinearly. This is adjoined by a second section 25 which extends such that it is angled away with respect to the first section 24. The second section 25 and the adjoining third section 26 are connected to one another such that they can be pivoted about a hinge 27, the hinge axis of the hinge 27 extending transversely with respect to the longitudinal direction of the wall 18.

The two movable walls 18 are actuated by two actuators 28 which can be configured, for example, as pneumatic cylinders, as shown in the figures. The left-hand wall 18 in the figures is actuated by the pneumatic cylinder which is oriented in the vertical direction parallel to the wall 17 and can be retracted and extended accordingly. The pneumatic cylinder is coupled to the first section 24 of the wall 18 via an angled part 29. The first section 24 of the wall is moved parallel to the upper wall 17 of the first conveying section 15 by retraction and extension of the pneumatic cylinder and is guided by the guide 21, with the result that pivoting of this wall 18 as shown in the figures results on account of the geometry of the sections 24, 25 and 26 and by the hinge 27 and the mounting in the aperture 22.

The right-hand wall 18 in the figures is likewise actuated via a pneumatic cylinder as actuator 28. For space reasons, however, this pneumatic cylinder is not oriented in the vertical direction, but operates such that it is directed obliquely or diagonally. The coupling to the first section 24 of the wall 18 takes place via a belt 30 which is coupled to the pneumatic cylinder and is guided over three transport rollers 31. That end of the pneumatic cylinder which can be extended linearly is coupled via a driver 38 to the belt 30, and the latter is in turn fastened via a coupling piece 39 to the first section 24 of the movable wall 18 which can be moved like the left-hand wall 18 in this way by extension and retraction of the pneumatic cylinder.

The cigarette stream 10 is fed to the cigarette magazine 11 from above the supply part 12, namely between two guide plates 32, 33 which are spaced apart in order to form a vertical shaft. The two guide plates 32, 33 are arranged offset laterally with respect to the upper opening of the supply part 12. In order to bridge this spacing, the cigarette stream 10 is transferred by the guide plates 32, 33 to a horizontally directed transport belt 34 which is mounted as an endless belt on two transport rollers 35. The cigarette stream 10 is transported by means of the transport belt 34 in the direction of the upper opening of the supply part 12. Here, the cigarette stream 10 is delimited on the upper side by a gravity-wheel chain 36. The gravity-wheel chain 36 is fastened firstly to the guide plate 32 and secondly to the fixed wall 17 of the supply part 12. The guide plates 32, 33 are of curved configuration in each case at the lower end, in order to deflect the cigarette stream 10 as far as possible without disruptions from the vertical conveying direction into the horizontal conveying direction. Furthermore, a housing wall 37 can be seen which is shown only partially. In addition, the fixed wall 17, on which the gravity-wheel chain 36 is also mounted, is fastened to the said housing wall 37.

Figure 3:
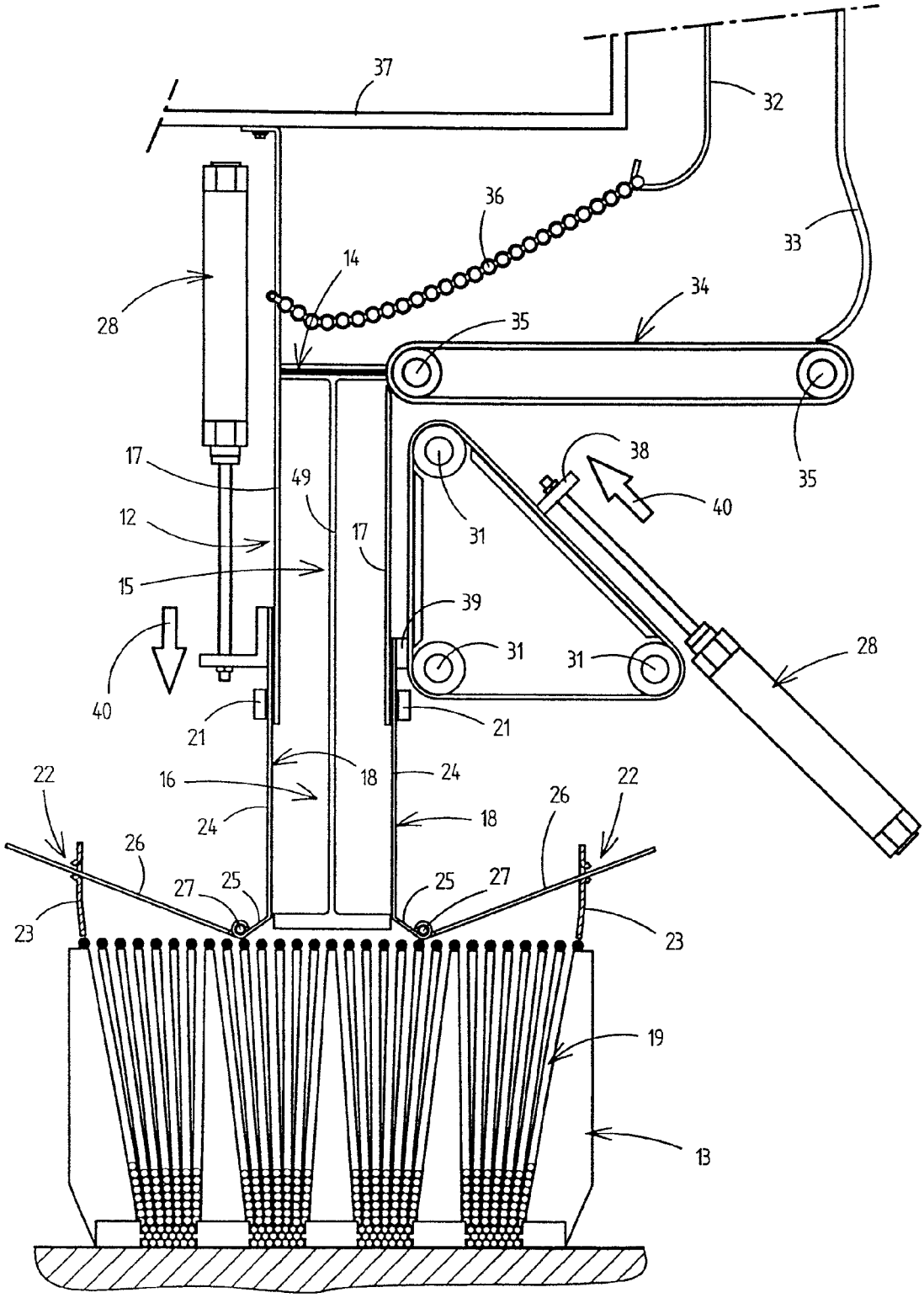
FIG. 3 shows the apparatus according to FIG. 1 in an initial position for conveying in a cigarette stream.

The apparatus which has been described above operates as follows:

FIG. 3 shows the start of conveying in a cigarette stream 10, in which the supply part 12 is free of cigarettes. There are also no cigarettes above the supply part 12. There are still a few cigarettes from the previous operation only in the shafts 19 of the cigarette magazine 11. In order to prepare for conveying in the cigarette stream 10, the supporting element 14 is moved to the upper end of the supply part 12 and is optionally pushed into the supply part 12. In this way, the supporting element 14 closes the conveying sections 15, 16 of the supply part 12. Furthermore, the actuators 28 are extended in the direction of the arrows 40 in such a way that the movable walls 18 are pivoted into a position for conveying in the cigarettes. In this position, the movable walls 18 extend as a continuation of the fixed walls 17, with the result that the first conveying section 15 and the second conveying section 16 have substantially identical cross-sectional dimensions. In this position, the cigarette stream 10 is not distributed over the entire width of the shaft part 13. The dimensions of the second conveying section 16 in the region of the movable walls 18 correspond substantially to the dimensions of the supporting element 14, as in the first conveying section 15.

Figure 4:
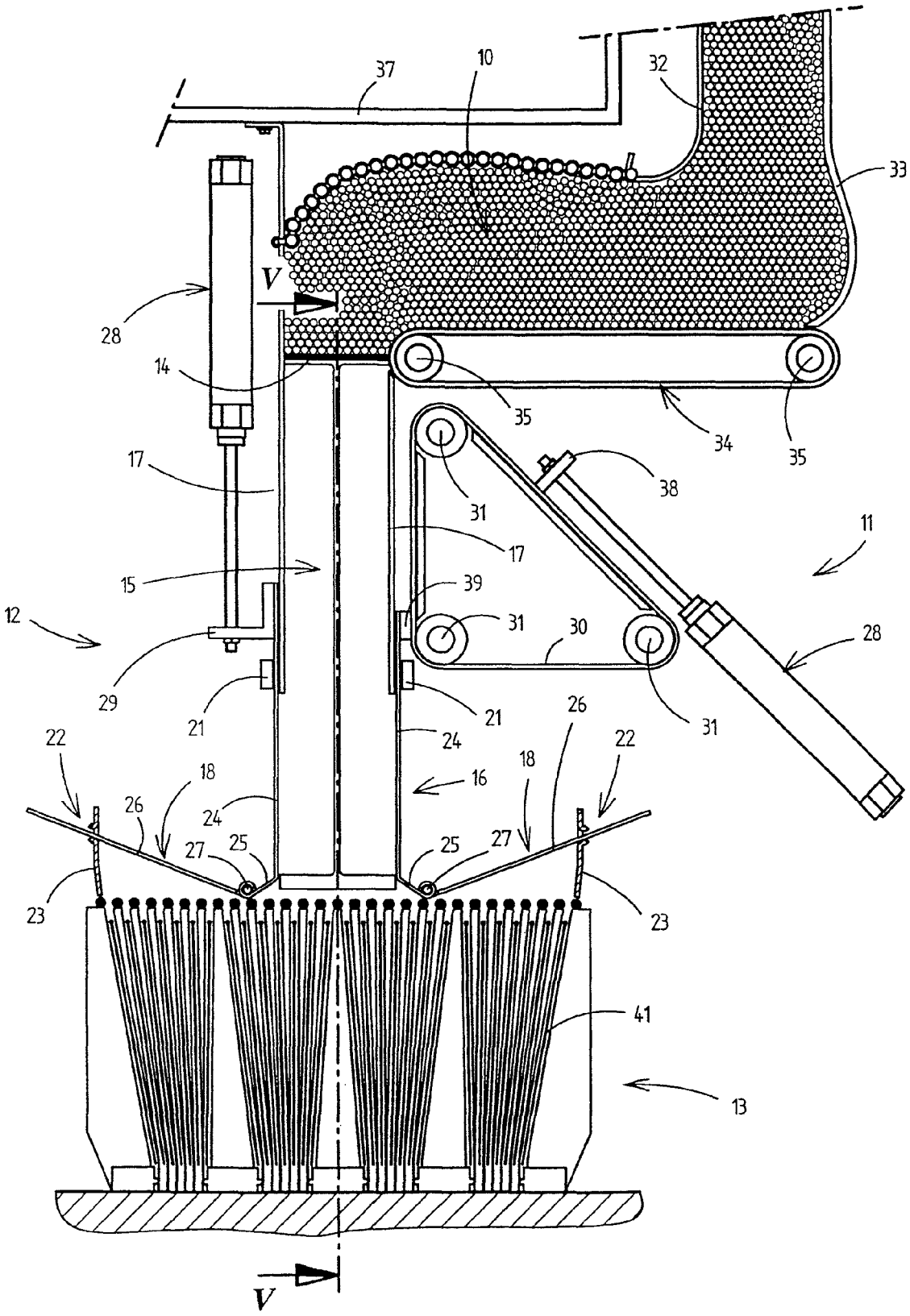

As can be seen from FIG. 4, in the next step the cigarette stream 10 is introduced into the region of the transport belt 34 and the gravity-wheel chain 36. The supporting element 14 prevents the cigarettes of the cigarette stream 10 from entering or falling into the two conveying sections 15, 16. Furthermore, the shafts 19 of the shaft part 13 are emptied, with the result that it is free from cigarettes. Subsequently, carrying rods 41 are moved upwards in the shafts 19, with the result that the cigarettes which are conveyed later into the shaft 19 are supported on the underside. This solution is also already known from European Patent No. EP 1 020 126 B1 from the applicant, which is incorporated herein and to which reference is made for the purpose of complete disclosure of the invention.

Figure 6:
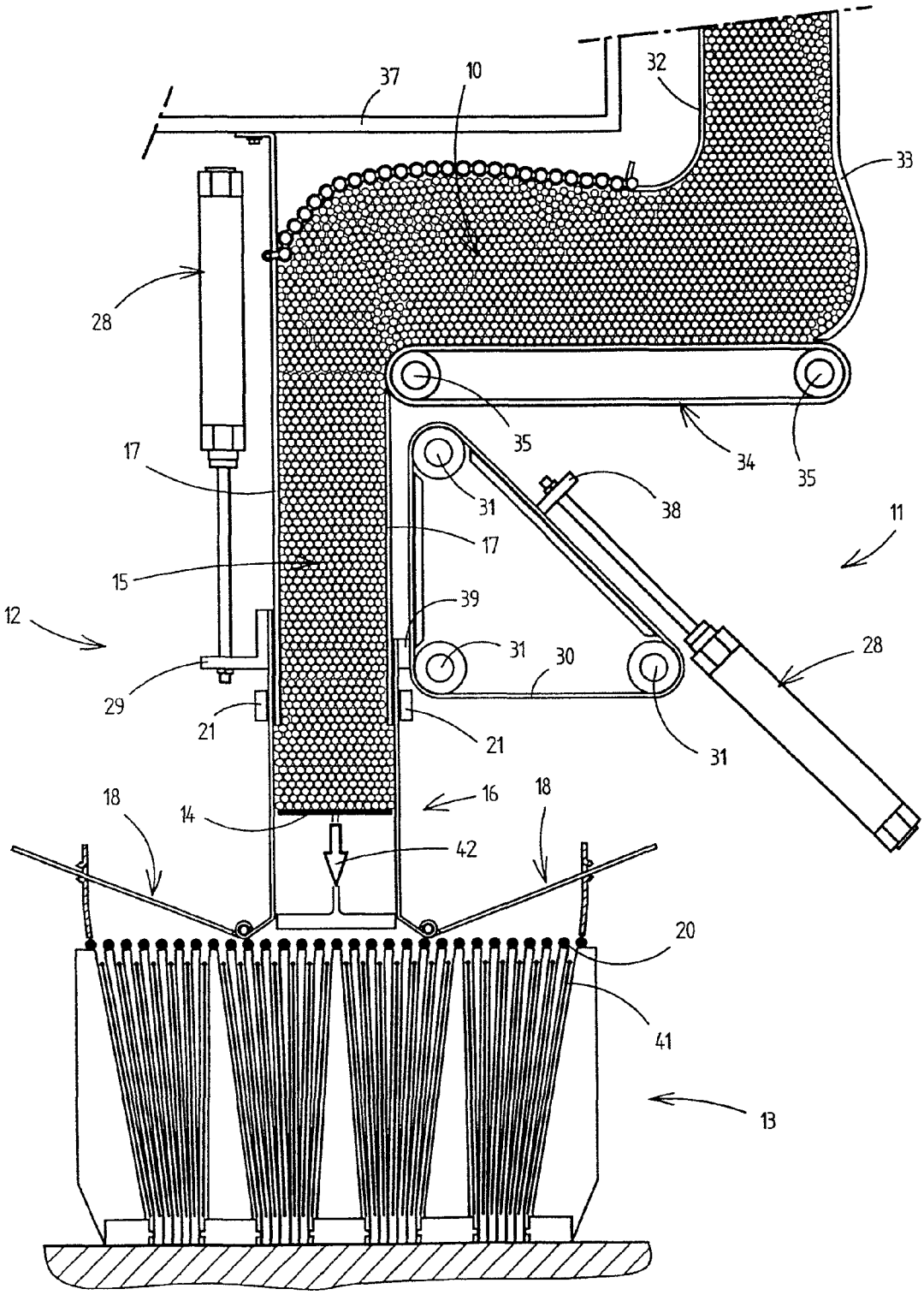

As can be seen from FIG. 6, the supporting element 14 is subsequently moved downwards in the direction of the arrow 42 along the two conveying sections 15, 16 in a known way, the cigarette stream 10 being conveyed one after another into the said two conveying sections 15, 16. As a result of the support of the cigarette stream 10 on the underside by means of the supporting element 14, incorrect positioning of the cigarettes does not occur. The lowering of the supporting element 14 is carried out, until it has arrived at the lower end of the second conveying section 16 of the supply part 12. Subsequently, in the present case, the supporting element 14 is pulled out of the second conveying section 16 transversely with respect to the plane of the drawing, with the result that the cigarettes of the cigarette stream 10 can pass via the vibratory rods 20 into the shafts 19 of the shaft part 13. There, they are conveyed downwards while they are being supported on the underside by the carrying rods 41, until the shafts 19 are filled completely. It is ensured in this way that the entire conveying section 15 or 16 is filled completely with cigarettes, without incorrect positioning occurring.

Figure 7:
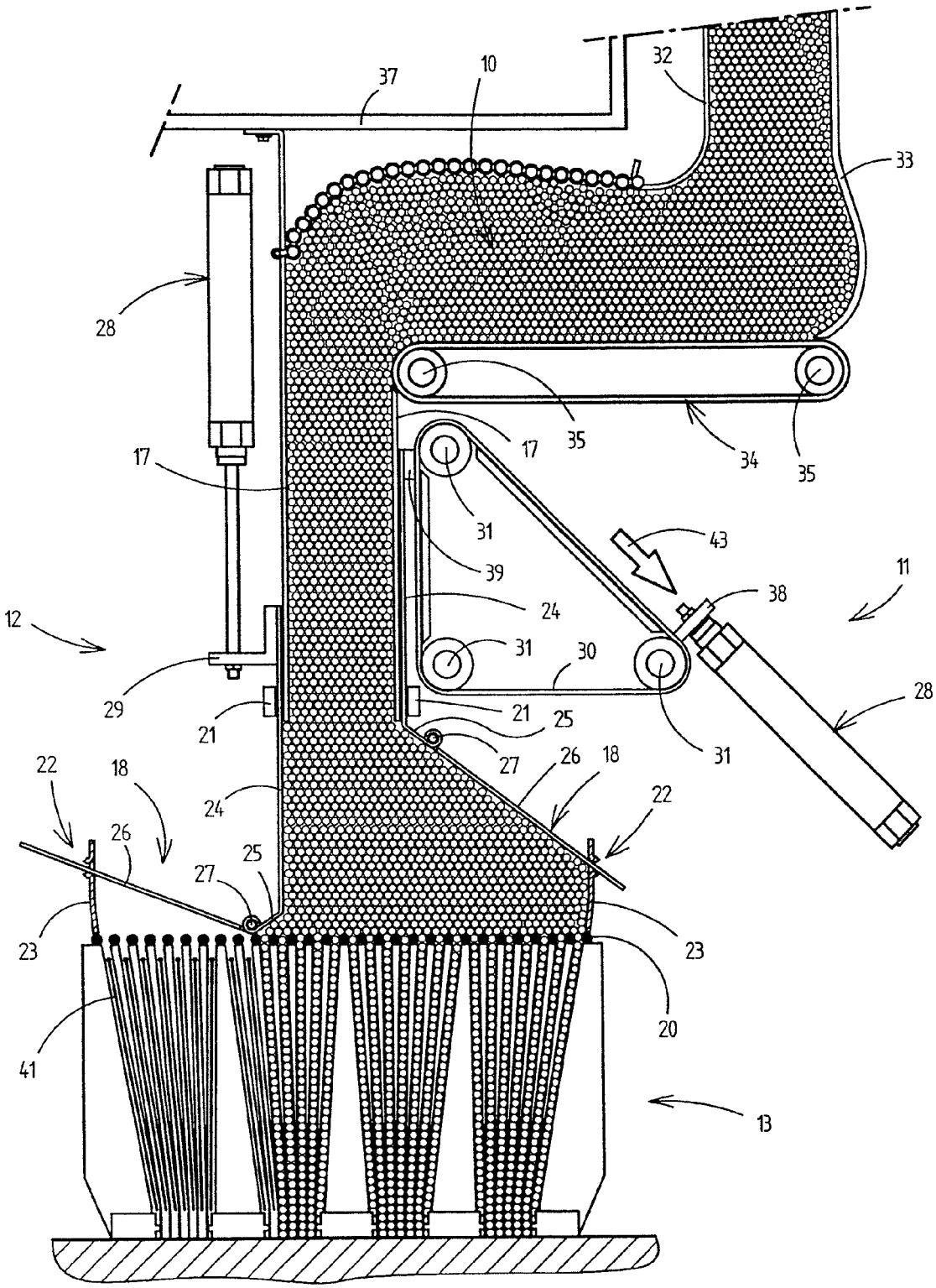
Figure 8:
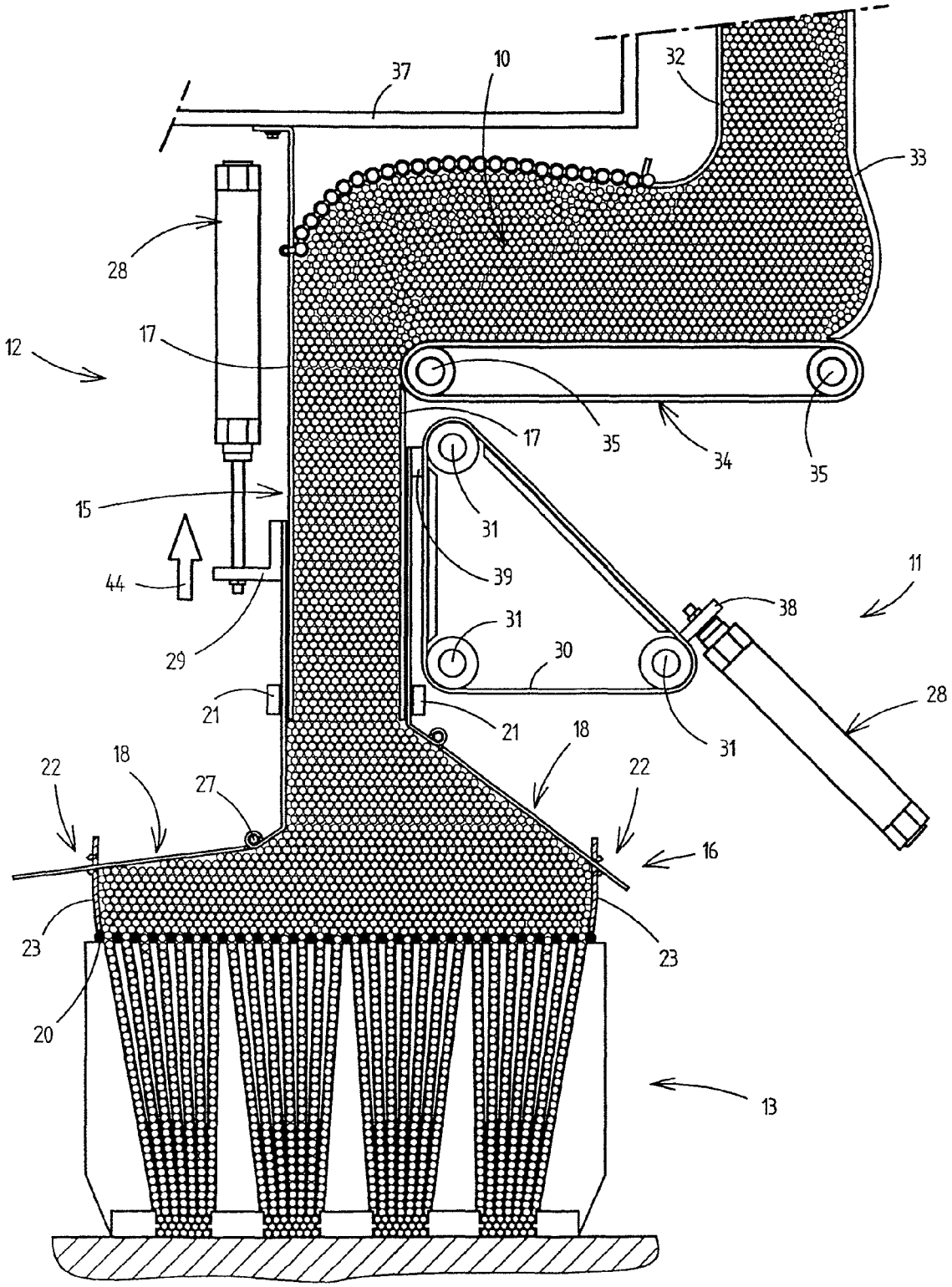

Subsequently, the cigarette stream 10 is distributed over the entire width of the shaft part 13 by pivoting of the two movable walls 18 of the second conveying section 16. This takes place by the actuators 28 being moved back successively into the initial position, as a result of which the walls 18 are moved correspondingly gradually into the position which is shown in FIG. 1. The movement direction of the actuators 28 is indicated in FIGS. 7 and 8 in each case by arrows 43 and 44. In accordance with the pivoting of the movable walls 18, the cigarette stream is distributed gradually over the entire width of the shaft part 13.

A further special feature is to be seen in the fact that the two walls 18 which lie opposite one another are not pivoted at the same time, but one after another with a time offset. As FIG. 7 shows, first of all the right-hand wall 18 in the drawing is moved and only after this the left-hand wall 18. It has been shown surprisingly that a further improved distribution of the cigarette stream 10 is possible as a result of this.

It is conceivable in principle to dispense with automatic adjustment of the walls 18 by means of actuators 28, pneumatic or hydraulic cylinders or the like, and instead to carry out manual adjustment of the walls 18 by an operator. The same is also true in principle for the supporting element 14. The latter can also be moved along the conveying sections 15, 16 by an operator. In this case, in particular, the supporting element 14 can also comprise a spongy material.

Figure 2:
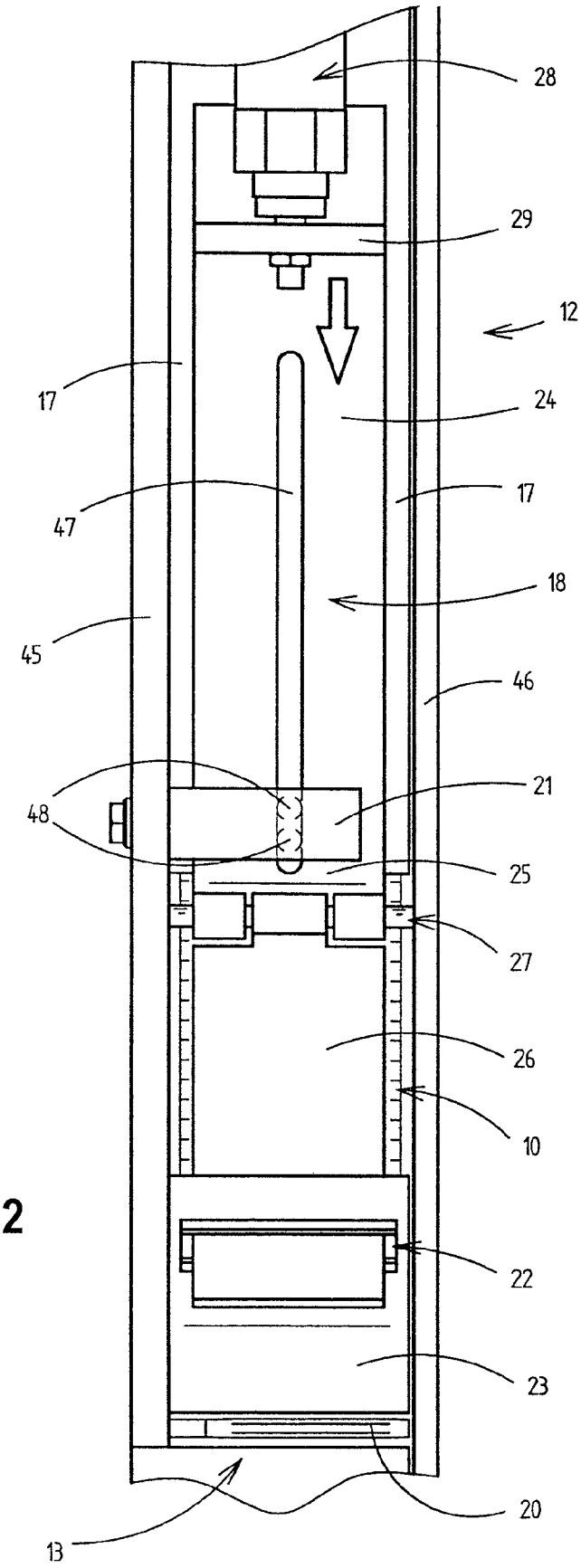
FIG. 2 shows a side view of the apparatus along line II-II according to FIG. 1.
Figure 5:
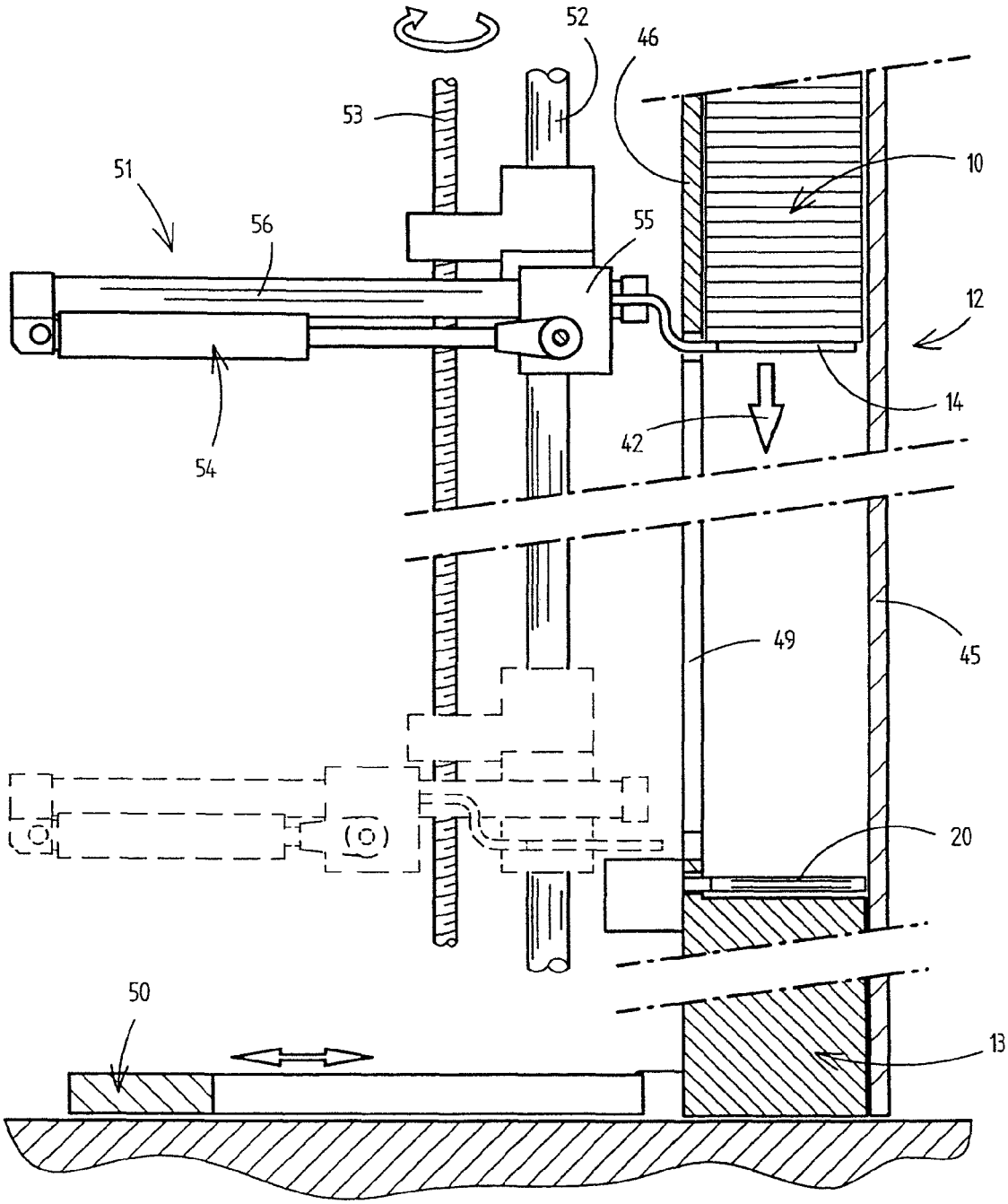
FIG. 5 shows a vertical section through the apparatus according to FIG. 4 along the sectional line V-V in FIG. 4.

Further structural details result from FIGS. 2 and 5:

Firstly, it can be seen in FIG. 2 that the conveying sections 15, 16 are not open at the front and at the back, but are closed by a front wall 45 and a rear wall 46, with the result that the conveying sections 15, 16 are substantially closed on all sides by walls. In addition, the guide 21 is fastened to the rear wall 46 and is in engagement via a vertical slot 47 in the movable wall 18. To this end, the guide 21 has roller bearings 48 or the like which engage into the slot 47 and thus ensure longitudinal guidance. In principle, the movable walls 18 can also be mounted via rollers or the like above the shaft part, instead of in the apertures 22.

FIG. 5 shows details of the drive of the supporting element 14. The supporting element 14 is mounted and driven outside the supply part 12 and protrudes into the supply part 12 through a slot 49 in the rear wall 46. The slot 49 is enlarged in the region of the upper and lower end positions of the supply part 12, with the result that the supporting element 14 can be pulled out of the supply part and can be pushed into the supply part 12 through the rear wall 46. The supporting element 14 is mounted on a drive unit 51 and is moved by the latter. In order to move the supporting element 14 in the vertical direction, the drive unit 51 is mounted on a vertical guide 52 and is connected to a rotatably drivable threaded rod 53, with the result that the drive unit 51 which is mounted on the guide 52 can be moved up and down in the vertical direction by rotation of the threaded rod 53. Furthermore, the drive unit 51 has a pneumatic cylinder 54 which can be retracted and extended horizontally and serves to move the supporting element in the horizontal direction into the supply part 12 and out of it again. The pneumatic cylinder 54 moves a receiving element 55 for the supporting element 14, the receiving element 55 being mounted on a horizontal guide 56 of the drive unit 51. FIG. 5 uses dashed lines to show the supporting element 14 in a lower position with a retracted pneumatic cylinder 54.

Furthermore, a slide 50 can be seen diagrammatically which can be moved to and fro and serves to push the cigarette groups out of the shaft part 13.

LIST OF REFERENCE NUMBERS

10 cigarette stream
11 cigarette magazine
12 supply part
13 shaft part
14 supporting element
15 conveying section
16 conveying section
17 wall
18 wall
19 shaft
20 vibratory rod
21 guide
22 aperture
23 wall
24 section
25 section
26 section
27 hinge
28 actuator
29 angled part
30 belt
31 transport roller
32 guide plate

33 guide plate
34 transport belt
35 transport roller
36 gravity-wheel chain
37 housing wall
38 driver
39 coupling piece
40 arrow
41 carrying rod
42 arrow
43 arrow
44 arrow
45 front wall
46 rear wall
47 slot
48 roller bearing
49 slot
50 slide
51 drive unit
52 guide
53 threaded rod
54 pneumatic cylinder
55 receiving element
56 guide

What is claimed is:

1. An apparatus for conveying a cigarette stream (10) in a controlled manner into a machine for producing and/or packaging cigarettes, the machine comprising an initially empty conveying section (16), and the cigarettes being conveyed into the initially empty conveying section (16), the apparatus comprising a movable supporting element (14), the cigarette stream (10) being supported during conveying by the movable supporting element (14), the movable supporting element (14) being moved together with the cigarette stream (10) along the conveying section (16), wherein:

the conveying section (16) is part of a cigarette magazine (11), the cigarette magazine (11) comprising an upper supply part (12) and a lower shaft part (13) having shafts (19) for cigarettes that are separated by shaft walls, with the supply part (12) comprising walls (18) that laterally delimit the supply part (12) of the cigarette magazine (11);

the walls (18) are movable at least partially in order to change the cross section of the supply part (12) of the cigarette magazine (11);

the supply part (12) of the cigarette magazine (11) is arranged with the walls (18) centrally and directly above the shaft part (13) of the cigarette magazine (11), the supply part (12) of the cigarette magazine (11) has a smaller width than that of the shaft part (13) of the cigarette magazine (11);

the walls (18) lie opposite one another and are pivotable into a diverging position such that the cigarette stream (10) is distributable over the full width of the shaft part (13) of the cigarette magazine (11); and the walls (18) are adjustable between a position for conveying the cigarettes into the empty supply part (12) and a position after the cigarettes have been conveyed into the empty conveying section (16), the walls (18) adjoining fixed walls (17) of the supply part (12), the walls (18) being substantially upright and below the fixed walls (17) in the position for conveying the cigarettes into the empty supply part (12);

the supply part (12) has a cross section that is constant substantially over the entire height of the supply part (12); and the walls (18) are moved into a diverging position after filling of the supply part (12), such that after the cigarettes have been conveyed into the empty supply part (12) the lower opening of the conveying section (16) corresponds substantially to the dimensions of the adjoining shaft part (13) having the shafts (19) for cigarettes, and wherein the shaft part (13) is fillable over its full width.

2. The apparatus according to claim 1, wherein the walls (18) of the conveying section (16) are mounted pivotably, wherein the cross section of the conveying section (16) is enlargeable by pivoting of the walls (18).

3. The apparatus according to claim 2, wherein the walls (18) are arranged adjacently to the fixed walls (17, 23) of the conveying section (16), and at least one of the fixed walls (17, 23) comprises a guide (21) for the walls (18).

4. The apparatus according to claim 2, wherein the supporting element (14) has substantially constant dimensions.

5. The apparatus according to claim 2, wherein the supporting element (14) has a substantially constant width.

6. The apparatus according to claim 1, wherein the walls (18) comprise at least one upper upright section (24) and one lower obliquely oriented section (26), and a hinge (27) having a hinge axis, the at least one upper upright section (24) and the one lower obliquely oriented section (26) being connected to one another via the hinge (27), and wherein the at least one upper upright section (24) and the one lower obliquely oriented section (26) are pivotable with respect to one another about the hinge axis.

7. The apparatus according to claim 6, further comprising one actuator (28), wherein the walls (18) each are adjustable by the one actuator (28) which acts in each case on the at least one upper upright section (24) and brings about the pivoting of the one lower obliquely oriented section (26) about the hinge axis by linear movement.

* * * * *